US006625838B2

(12) United States Patent
Laux et al.

(10) Patent No.: US 6,625,838 B2
(45) Date of Patent: Sep. 30, 2003

(54) MOP WITH SELF-CONTAINED WRINGER SLEEVE

(75) Inventors: Christopher Laux, Hamilton, OH (US); David Hunt, Cincinnati, OH (US); Robert Roth, Cincinnati, OH (US)

(73) Assignee: O-Cedar Brands, Inc., Springfield, OH (US)

( * ) Notice: Subject to any disclaimer, the term of this patent is extended or adjusted under 35 U.S.C. 154(b) by 131 days.

(21) Appl. No.: 09/759,065

(22) Filed: Jan. 12, 2001

(65) Prior Publication Data

US 2002/0092105 A1 Jul. 18, 2002

(51) Int. Cl.[7] ..... A47L 13/142
(52) U.S. Cl. ..... 15/120.2; 15/120.1
(58) Field of Search ..... 15/116.1, 119.1, 15/120.1, 120.2

(56) References Cited

U.S. PATENT DOCUMENTS

| | | | | | |
|---|---|---|---|---|---|
| 135,400 | A | * | 2/1873 | Boyden | 15/120.2 X |
| 1,514,051 | A | * | 11/1924 | Jumonville | 15/120.2 |
| 1,520,500 | A | * | 12/1924 | Jumonville | 15/120.2 |
| 1,709,622 | A | | 4/1929 | Justis | |
| 1,735,280 | A | * | 11/1929 | Hertzberg | 15/120.2 |
| 1,861,795 | A | * | 6/1932 | Hertzberg | 15/120.2 |
| 2,677,838 | A | | 5/1954 | Jouban | |
| 3,364,512 | A | | 1/1968 | Yamashita et al. | |
| 3,946,457 | A | | 3/1976 | Robinson | |
| D311,077 | S | | 10/1990 | Nakamura et al. | |
| 5,060,338 | A | | 10/1991 | Yates et al. | |
| 5,509,163 | A | | 4/1996 | Morad | |
| D387,526 | S | | 12/1997 | Berti et al. | |
| D387,527 | S | | 12/1997 | Specht | |
| 5,724,694 | A | | 3/1998 | Lewis | |
| 5,727,281 | A | | 3/1998 | Harper | |
| 5,819,356 | A | | 10/1998 | Cann | |
| 5,850,658 | A | | 12/1998 | Specht | |
| 6,085,378 | A | | 7/2000 | Petner | |
| 6,108,848 | A | | 8/2000 | Monahan | |
| 6,112,358 | A | | 9/2000 | Specht | |
| 6,115,869 | A | | 9/2000 | Libman | |
| 6,212,728 | B1 | * | 4/2001 | Facca et al. | 15/120.2 |
| 6,427,280 | B1 | * | 8/2002 | Specht | 15/120.2 |

FOREIGN PATENT DOCUMENTS

| | | | | |
|---|---|---|---|---|
| CH | 287161 | * | 3/1953 | 15/120.2 |
| DE | 3607121 | * | 9/1987 | 15/119.1 |
| FR | 2622785 | * | 5/1989 | 15/120.1 |
| GB | 1300709 | * | 12/1972 | 15/120.2 |
| IT | 584319 | * | 10/1958 | 15/120.2 |

* cited by examiner

*Primary Examiner*—Mark Spisich
(74) *Attorney, Agent, or Firm*—Robert R. Lech; Calfee, Halter & Griswold LLP

(57) ABSTRACT

A mop including a mop handle and a mop head located at one end of the handle and including a plurality of flexible strands defining a mop body. A sleeve is positioned on the mop handle and is supported for slidable movement in an axial direction parallel to the handle, and is further supported for rotatable movement relative to the handle. A lower end of the sleeve is provided with engagement portions defined by slots for engaging and gripping the strands of the mop body to facilitate twisting of the mop body by the sleeve. In addition, a ratchet and pawl mechanism is provided by cooperating portions of the mop body and sleeve to limit rotation of the sleeve to a single direction during a wringing operation.

24 Claims, 13 Drawing Sheets

MOP WITH SELF-CONTAINED WRINGER SLEEVE

BACKGROUND OF THE INVENTION

1. Field of the Invention

The present invention relates to a wet mop. More particularly, the invention relates to a wet mop having a self-contained wringer sleeve which is slidably movable along a mop handle to engage and wring liquid from a mop body located at one end of the mop handle.

2. Related Prior Art

There exist numerous types of mops in the art used to clean surfaces such as floors, the mops including twist mops, squeeze mops, ringer mops, etc. Each of these mops include a handle for supporting a mop head at one end thereof and additionally typically include means for removing liquid from the mop head.

In one such construction, a wringing tube or sleeve is mounted to the handle and is adapted to be slid over a mop head to wring or compress water therefrom. Further, the sleeve in one known prior art type device is configured to ensure a certain degree of resistance between the sleeve and the mop head to facilitate twisting, and preferably complete wringing, of the mop head. For example, U.S. Pat. No. 1,709,622 (Justis) shows providing inwardly extending ribs on a sleeve located between opposing longitudinal ends of the sleeve to facilitate engagement of the strands of a mop head. A further example of such a mop is shown in U.S. Pat. No. 5,060,338 (Yates et al.) which discloses a sleeve formed with a plurality of inwardly extending grooves extending along a substantial portion of the axial length of the sleeve and located between the opposing ends of the sleeve.

In other constructions of sleeves for squeezing a mop head, the sleeve is configured to provide a compression of the mop head to thereby compress water from the mop strands. For example, U.S. Pat. No. 6,108,848 (Monahan) shows a housing for compressing the mop head wherein the housing is provided with a slit to permit the housing to movably overlap itself and change a mop head receiving surface area to compress water from the mop head. A further known construction is disclosed in U.S. Pat. No. 6,085,378 (Petner) which shows a sleeve including a plurality of rollers for engaging and wringing a mop head as the sleeve is moved longitudinally down over the mop head.

There is a continuing need to provide an improved means for wringing a mop head, and in particular, there is a continuing need for providing a self-contained wringer which is capable of efficiently manipulating a mop head to dispense liquid therefrom during a wringing operation of the mop head.

SUMMARY OF THE INVENTION

The present invention provides a mop including an elongated handle having opposing ends and a mop head located at one end of the handle and including a plurality of flexible strands defining a mop body. A sleeve is positioned on the mop handle and is supported for slidable movement in an axial direction parallel to the longitudinal axis of the handle.

The sleeve comprises a tubular shell defined by inner and outer surfaces and including axially spaced, opposing first and second ends. The sleeve further comprises an upper grip portion and a lower mop head receiving portion wherein the inner surface of the grip portion is generally sized to be in close relation to the mop handle and provide a guide for guiding the sleeve in longitudinal movement, and the mop body receiving portion is sized to receive the flexible strands of the mop body.

The second end of the sleeve, at the lower end of the mop body receiving portion, is provided with an engagement portion for engaging the mop body and facilitating gripping and twisting of the mop strands during rotational movement of the sleeve relative to the handle. The engagement portion is preferably defined by engagement surfaces extending between the inner and outer surfaces of the sleeve, and most preferably are defined by cutout or slot portions extending axially inwardly from the second end of the sleeve. The slot portions are configured to facilitate engagement between the sleeve and mop strands wherein the mop strands will be engaged through the areas defined by the slot portions.

In addition, cooperating portions are provided between the handle and sleeve for permitting rotation of the sleeve relative to the handle in one direction and for preventing rotation of the sleeve in a second, opposite direction. The cooperating portions are defined by a pawl portion cooperating with a detent portion wherein in a preferred embodiment, the detent portion is defined by ribs extending longitudinally along the inner surface of the grip portion of the sleeve and the pawl portion is defined by resiliently biased pawl members which are preferably formed integrally with the mop head. The cooperating portions will be engaged with each other when the sleeve is located in a lower position covering the mop head, and the cooperating portions may be disengaged from each other by sliding the sleeve upwardly to separate the cooperating portions from each other.

The sleeve is preferably held in a raised position on the handle when not in use. This is accomplished by providing a generally cylindrical hand grip attached to the handle between the first and second ends thereof, which hand grip defines a gripping surface located radially outwardly from a surface of the handle. The inner surface of the grip portion of the sleeve defines a diameter which is substantially equal to or slightly less than the outer diameter of the hand grip whereby sliding the sleeve upwardly to engage the grip portion of the sleeve with the hand grip will result in frictional engagement of the sleeve with the hand grip.

Other aspects of the invention will be apparent from the following description, the accompanying drawings and the appended claims.

DETAILED DESCRIPTION OF THE PREFERRED EMBODIMENT

Figure 1:
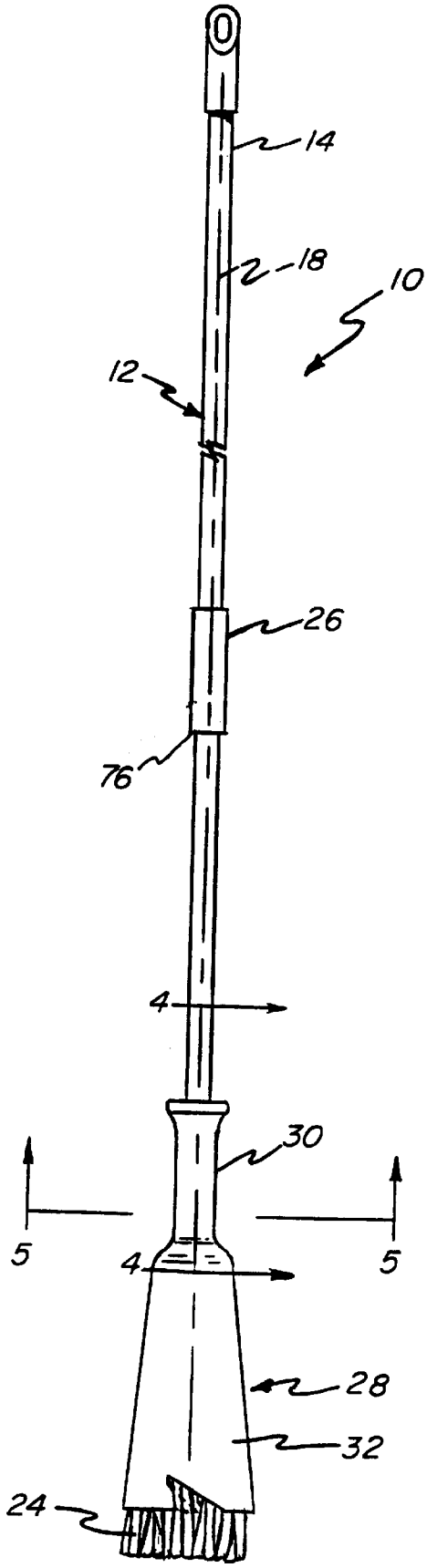
FIG. 1 is a perspective view of the mop of the present invention with the wringer sleeve in a lowered position for wringing a mop head.
Figure 2:
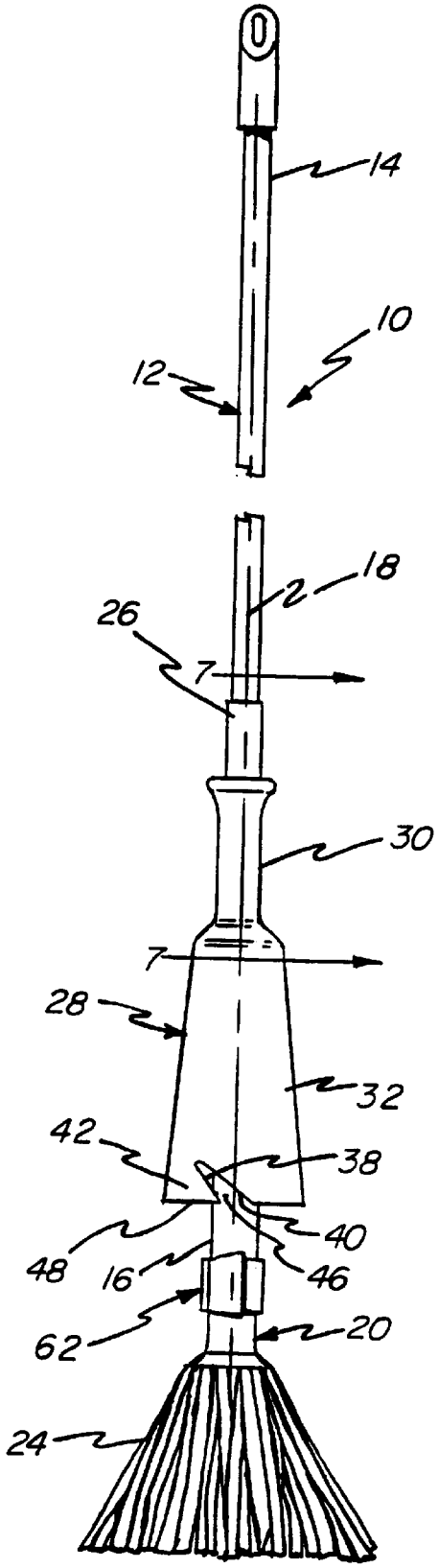
FIG. 2 is a perspective view of the mop of the present invention with the wringer sleeve in an elevated position.
Figure 3:
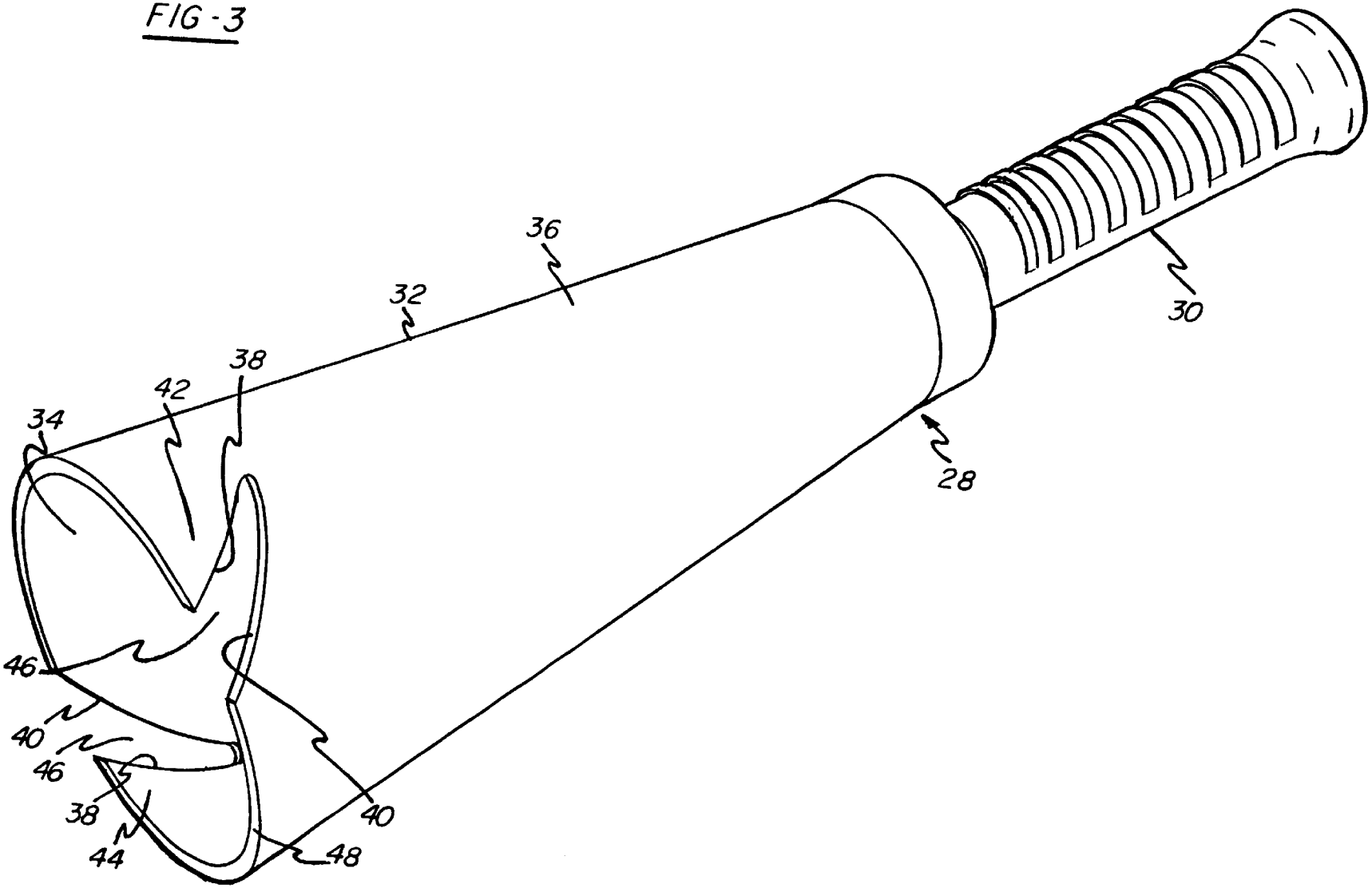
FIG. 3 is a perspective view of the wringer sleeve of the mop of FIGS. 1 and 2.

Referring to FIGS. 1 and 2, the mop 10 of the present invention includes a mop handle 12 having a first end 14 and a second end 16 and defining a longitudinal axis 18. A mop head 20 is located at the second end 16 of the handle 12 and, as may be seen in FIG. 4, the mop head is preferably formed with a threaded aperture 22 for threadably receiving a threaded portion of the second end 16 of the mop handle 12 whereby the mop head 20 is removably mounted to the handle 12 in a conventional manner.

The mop head 20 includes a plurality of flexible strands 24 defining a mop body. The mop head 24 may be formed of any strand material known in the art, including strips of absorbent and durable material, such as woven or non-woven natural or synthetic materials, or may consist of a yarn material or any other material capable of providing a strand-like mop body.

The mop 10 further includes a cylindrical hand grip 26 located intermediate the first end 14 and second end 16 and defining a gripping surface located radially outwardly from a surface of the handle 12. The hand grip 26 is preferably formed of a resilient material, such as a soft vinyl material formed to provide a textured, non-slip surface. The location of the hand grip 26 is provided such that it may be used to facilitate a wringing operation, as will be described further below.

The mop 10 is additionally provided with a wringer element comprising a sleeve 28 including a first, upper grip portion 30 and a second, lower mop body receiving portion 32. As may be seen with reference to FIGS. 1–4, the sleeve 28 is defined by an inner surface 34 and an outer surface 36 extending circumferentially around the longitudinal axis 18 to form a tubular shell surrounding and slidable along the mop handle 12. In particular, it should be noted that the inner surface 34 along the grip portion 30 is formed with a diameter greater than the diameter of the mop handle 12 whereby the sleeve 28 is both rotatable and longitudinally movable relative to the handle 12.

The mop body receiving portion 32 of the sleeve 28 is formed with a larger diameter than the grip portion 30 and defines an engagement portion for engaging the mop body 24 and for facilitating gripping and twisting of the mop strands during rotational movement of the sleeve 28 relative to the handle 12. In particular, the mop body receiving portion 32 of the sleeve 28 is preferably formed with an oval shape for compressing the mop body 24 to a greater extent along a minor axis of the mop body receiving portion 32, and further includes engagement surfaces 38, 40 extending between the inner and outer surfaces 34, 36 of the sleeve 28 which are defined on axially protruding portions 42, 44. The protruding portions 42, 44 define axially extending slots 46 therebetween at a distal extent 48 of the sleeve 28. In the preferred embodiment, a pair of diametrically opposed slots 46 are provided in the sleeve 28, although it should be understood that a different number of slots 46 may be provided within the scope of the present invention.

In use, the sleeve 28 is moved downwardly to engage the inner surface 34 of the second end 32 over the mop body 24. As the sleeve 28 is moved downwardly, a plurality of the strands forming the mop body 24 will extend through the slots 46 and be engaged by the engagement surfaces 38, 40. The slots 46 are oriented at an angle relative to the longitudinal axis 18 such that the strands of the mop body 24 are directed into the slots 46 as the sleeve 28 is rotated in a clockwise direction, as viewed from the bottom of the mop 10. Thus, as the sleeve 28 is rotated, the slots 46 facilitate engagement with and twisting of the mop strands to produce a rotational wringing movement of the strands of the mop body 24 relative to the handle 12. Further, it should be noted that the hand grip 26 on the handle 12 and the grip portion 30 on the sleeve 28 provide convenient locations for a person to grip and rotate the sleeve 28 relative to the handle 12.

Figure 4:
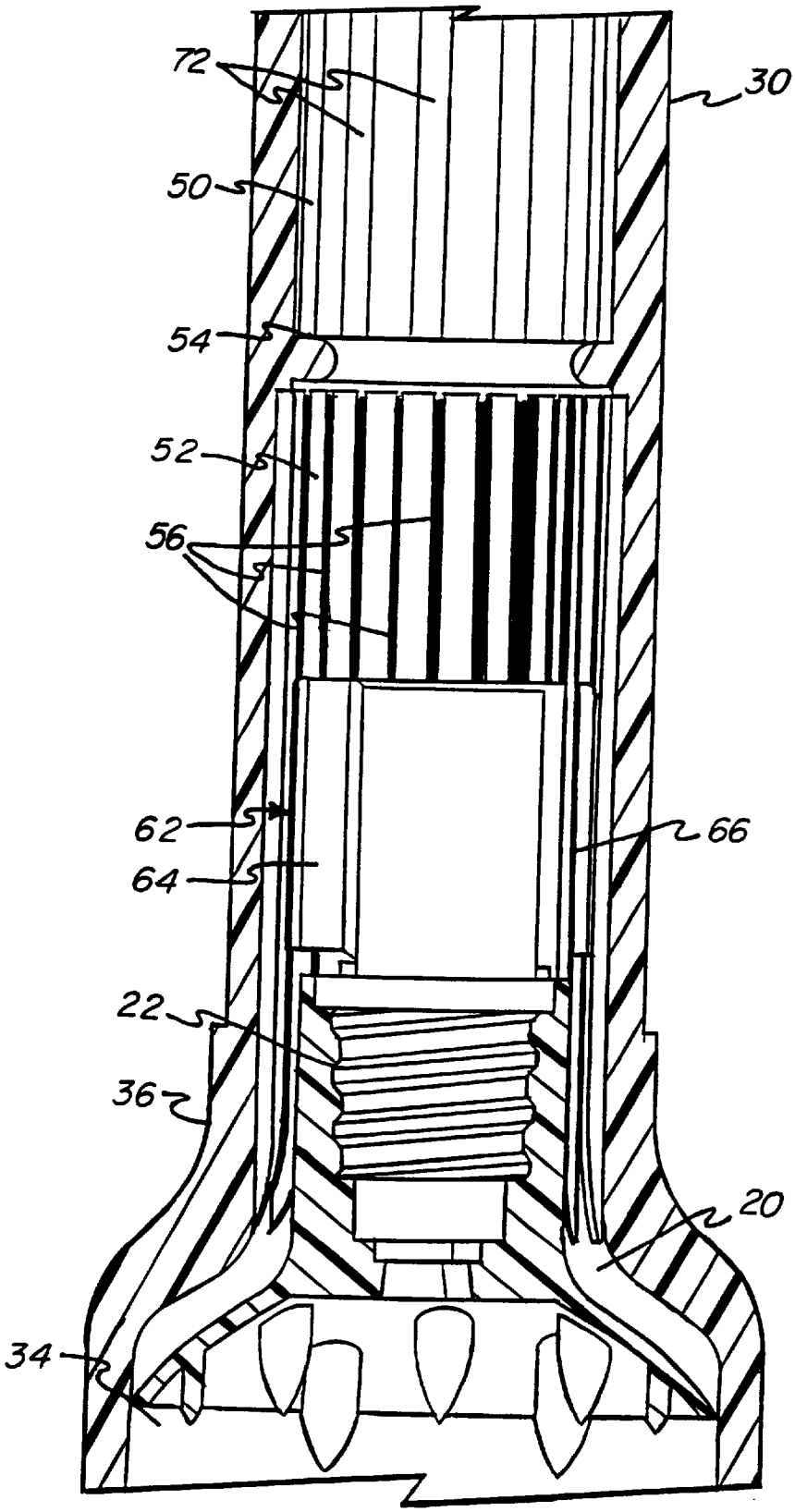
FIG. 4 is a cross-sectional view through the upper portion of the mop head with the first and second cooperating portions of the wringer sleeve and mop head engaged with each other, and without the mop handle in place.
Figure 5:
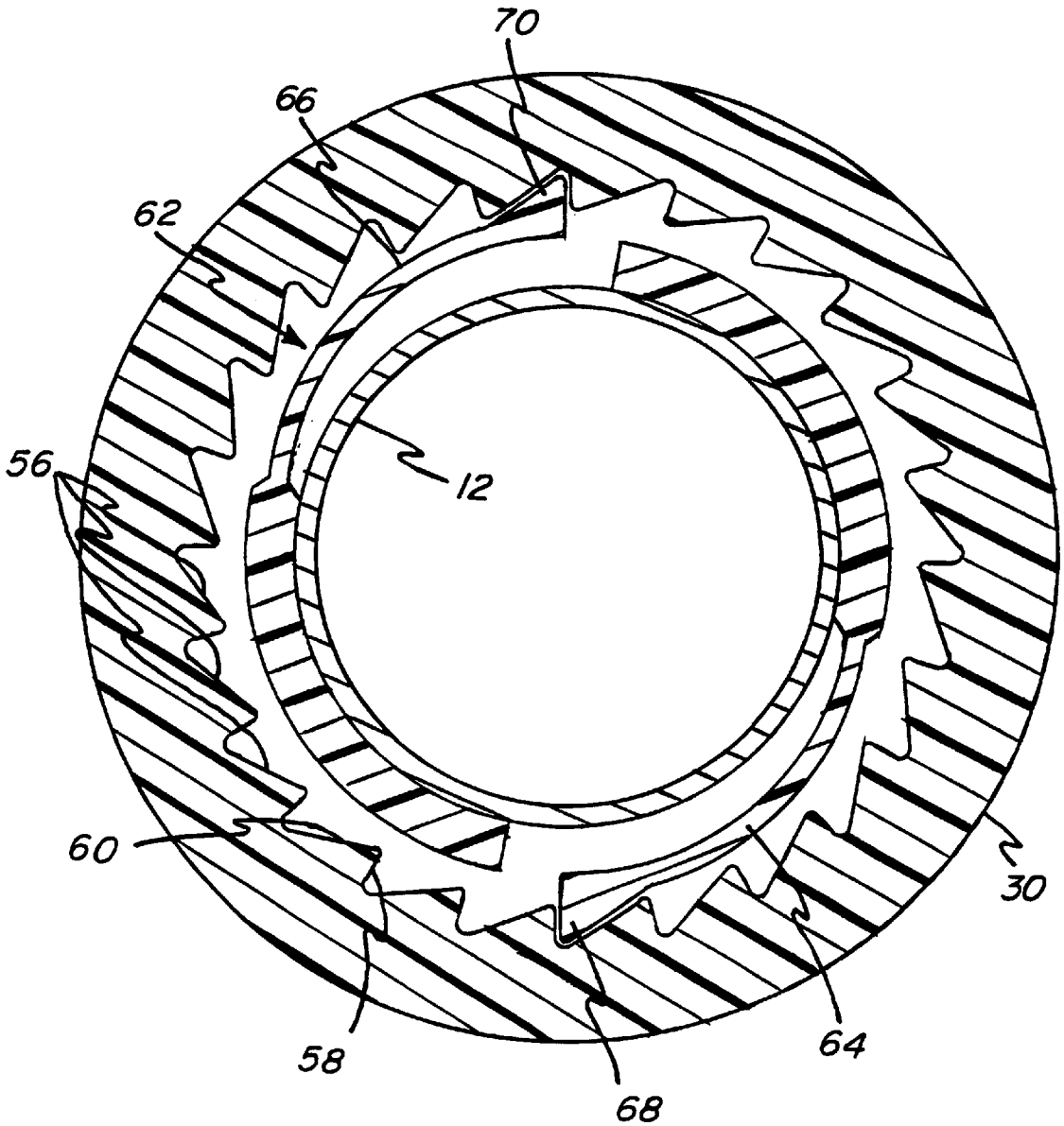
FIG. 5 is a cross-sectional bottom plan view illustrating the first and second cooperating portions engaged with each other.

Referring to FIGS. 4 and 5, the grip portion 30 of the sleeve 28 includes an upper portion 50 and a lower portion 52 separated by a radially inwardly extending flange 54. The inner surface 34 of the lower portion 52 of the grip portion 30 defines a plurality of radially inwardly extending ribs 56, each rib 56 including a first surface 58 substantially parallel to a plane passing through the longitudinal axis 18, and a second, angled surface 60 defining a ramp extending toward the first surface 58.

Figure 6:
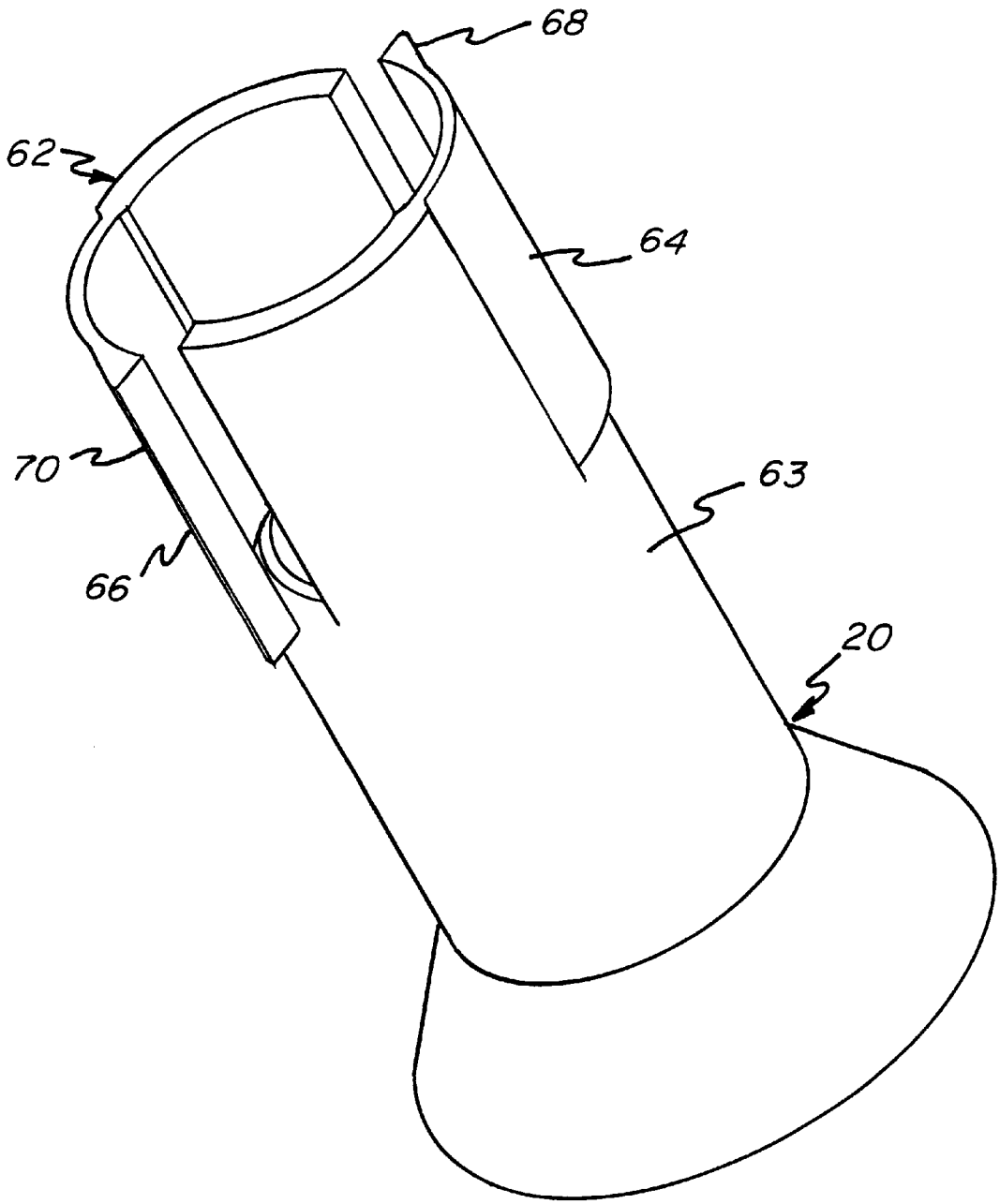
FIG. 6 is a perspective view of the mop head without the strands.

Referring additionally to FIG. 6, the mop head 20 includes a pawl portion 62 formed integrally at an upper end thereof, and including a cylindrical base portion 63 and, a pair of pawl members 64, 66 located at diametrically opposed locations above the base portion 63, and having respective end portions 68, 70 for engagement with the ribs 56. Thus, the ribs 56 and pawl portion 62 define first and second cooperating portions, respectively, wherein the pawl members 64, 66 are resiliently movable in a radial direction as the sleeve is rotated in a clockwise direction, as seen in the bottom end view of the FIG. 4, to wring the strands of the mop body 24 wherein the pawl members 64, 66 will resiliently ride along the ramp portions 60. Alternatively, the end portions 68, 70 of the pawl members 64, 66 will engage the first surfaces 58 of the ribs 56 if rotation of the sleeve 28 is attempted in the opposite direction. In this manner, rotation of the sleeve 28 in only one direction is ensured, which facilitates engagement of the strands within the slots 46, and further ensures that the strands of the mop body 24 are rotated in such a direction as to prevent the mop body from rotating in a direction to unscrew the threaded portion 22 from the end of the mob handle 12.

In performing a wringing operation, the sleeve 28 is moved longitudinally downwardly toward the mop head 20 to the position shown in FIG. 2 whereby the first and second cooperating portions defined by the ribs 56 and the pawl portion 62 are brought into engagement with each other. The hand grip 26 provides a location on the handle 12 for an operator to hold the mop handle 12, and the operator may further grip the exterior surface 36 of the grip portion 30 of the sleeve 28 in order to rotate the sleeve 28 relative to the mop body 24. During the rotation of the sleeve 28, the pawl members 64, 66 cooperate with the detents defined by the ribs 56 to facilitate continuous rotation of the sleeve 28 in one direction relative to the mop handle 12.

Figure 7:
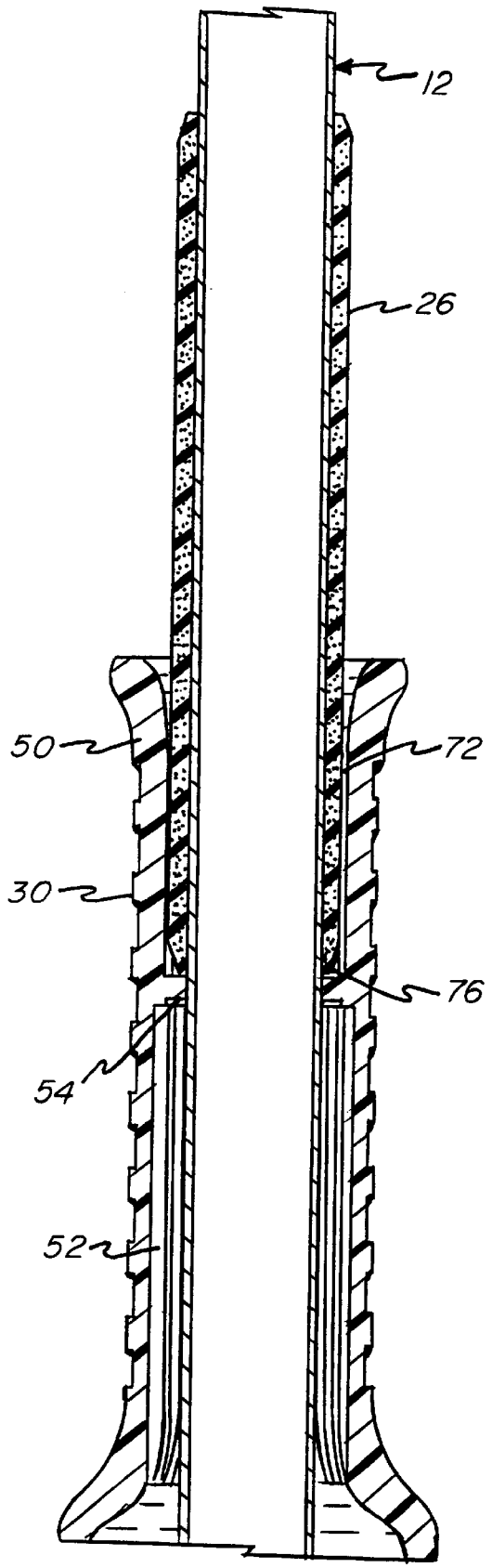
FIG. 7 is a cross-sectional view through the handle and wringer sleeve with the wringer sleeve engaged in a raised position.

Referring to FIGS. 4 and 7, the upper portion 50 of the grip portion 30 of the sleeve 28 includes a plurality of rounded ribs 72 defining a diameter slightly less than the diameter of the hand grip 26. In a storage position of the sleeve 28, the sleeve may be moved upwardly to the position shown in FIG. 1 to engage the ribs 72 of the upper portion 50 over the hand grip 26 whereby the frictional engagement between the inner surface of the grip portion 30 of the sleeve 28 and the hand grip 26 maintains the sleeve 28 in an elevated position out of engagement with the mop body 24. Further, during upward movement of the sleeve 28, the flange 54 engages with an end surface 74 (FIG. 1) of the hand grip 26 whereby the flange 54 acts as a stop to define the upper longitudinal position for the sleeve 28.

Figure 8:
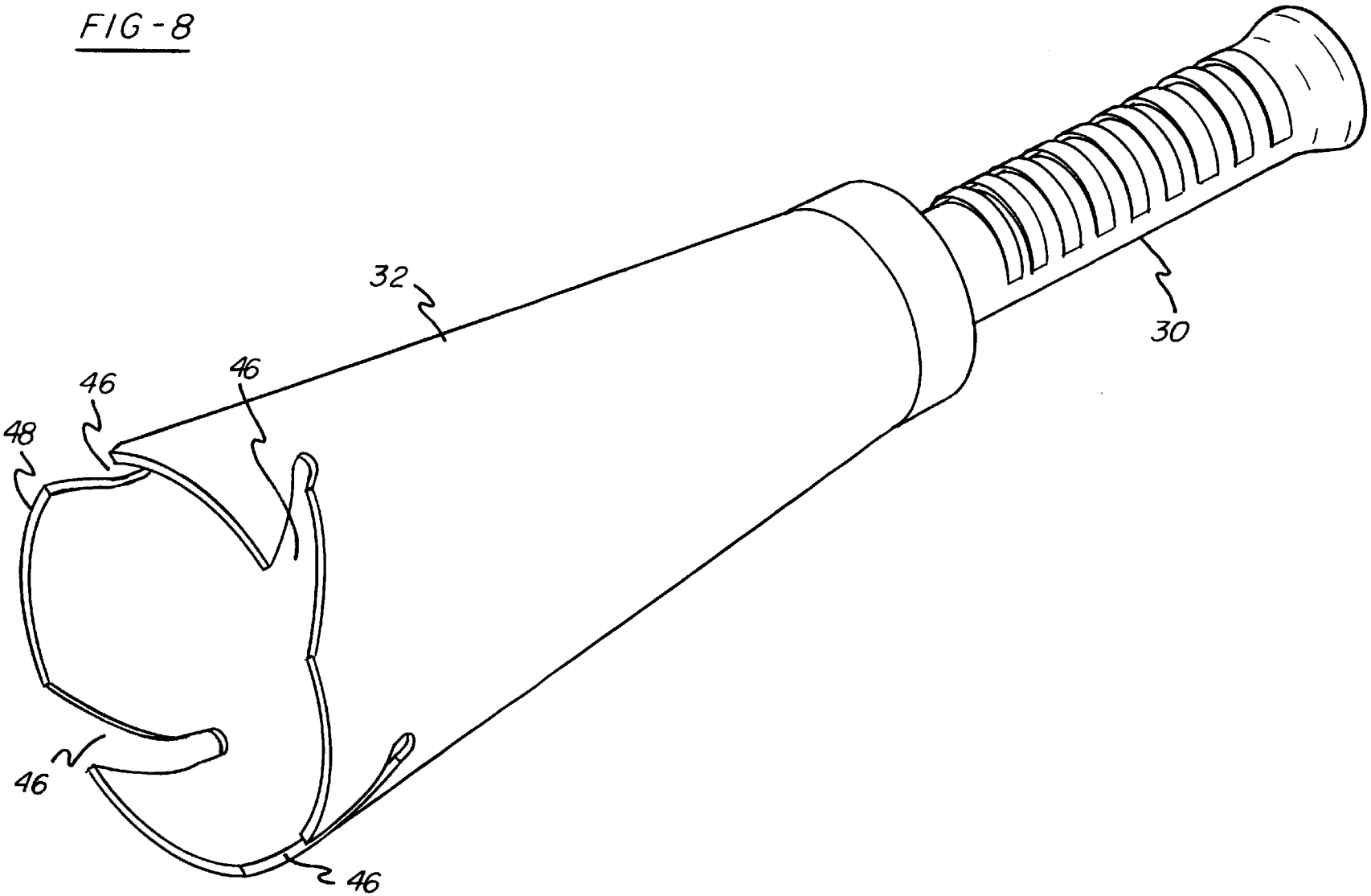
FIGS. 8 and 9 are perspective and bottom end views, respectively, of a first alternative embodiment of the wringer sleeve.
Figure 9:
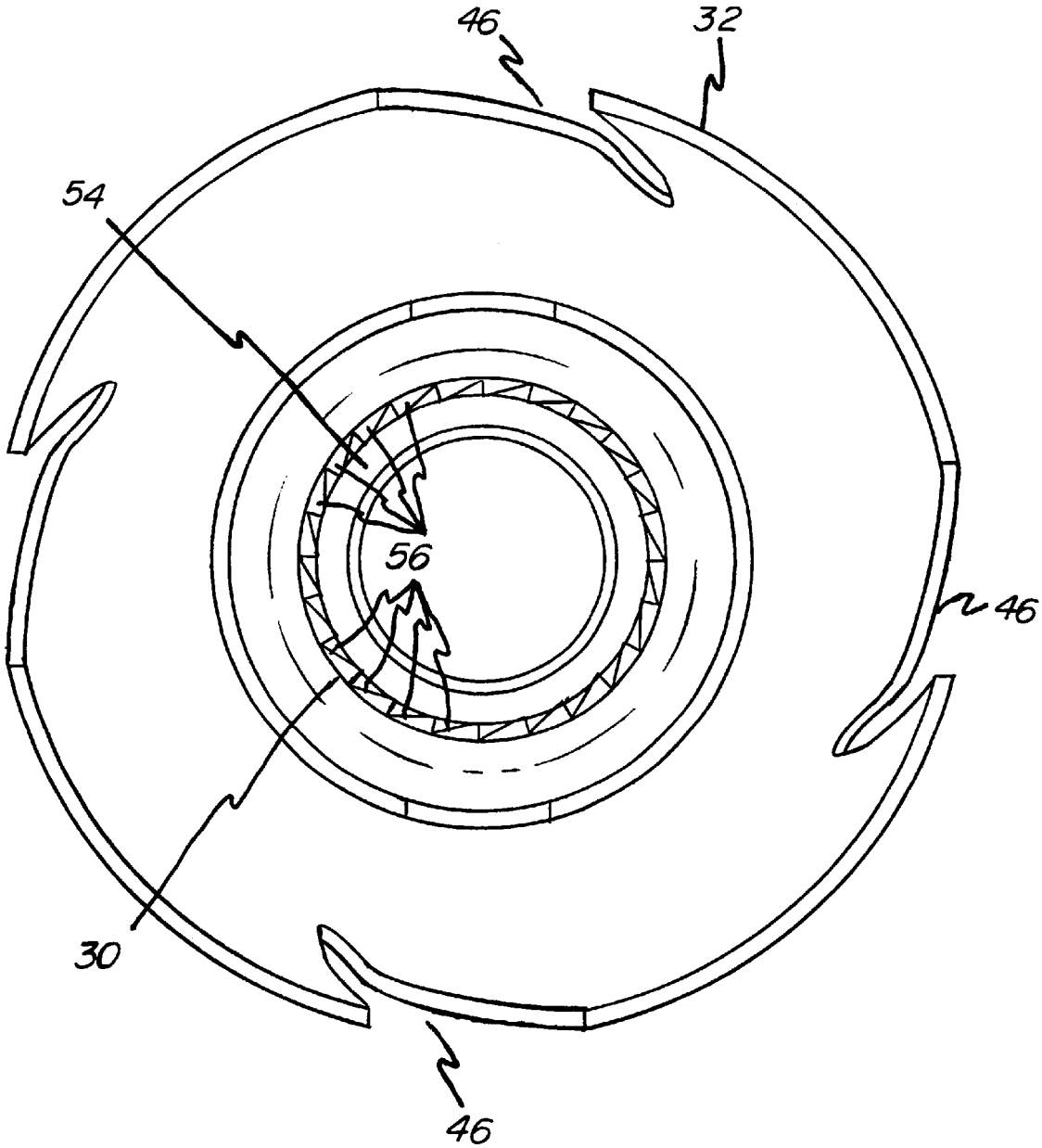

Referring to FIGS. 8 and 9, a first alternative embodiment of the wringer sleeve is illustrated in which the mop body receiving portion 32 is formed with a circular shape and three slots 46 are provided in the distal end 48 of the mop body receiving portion 32.

Figure 10:
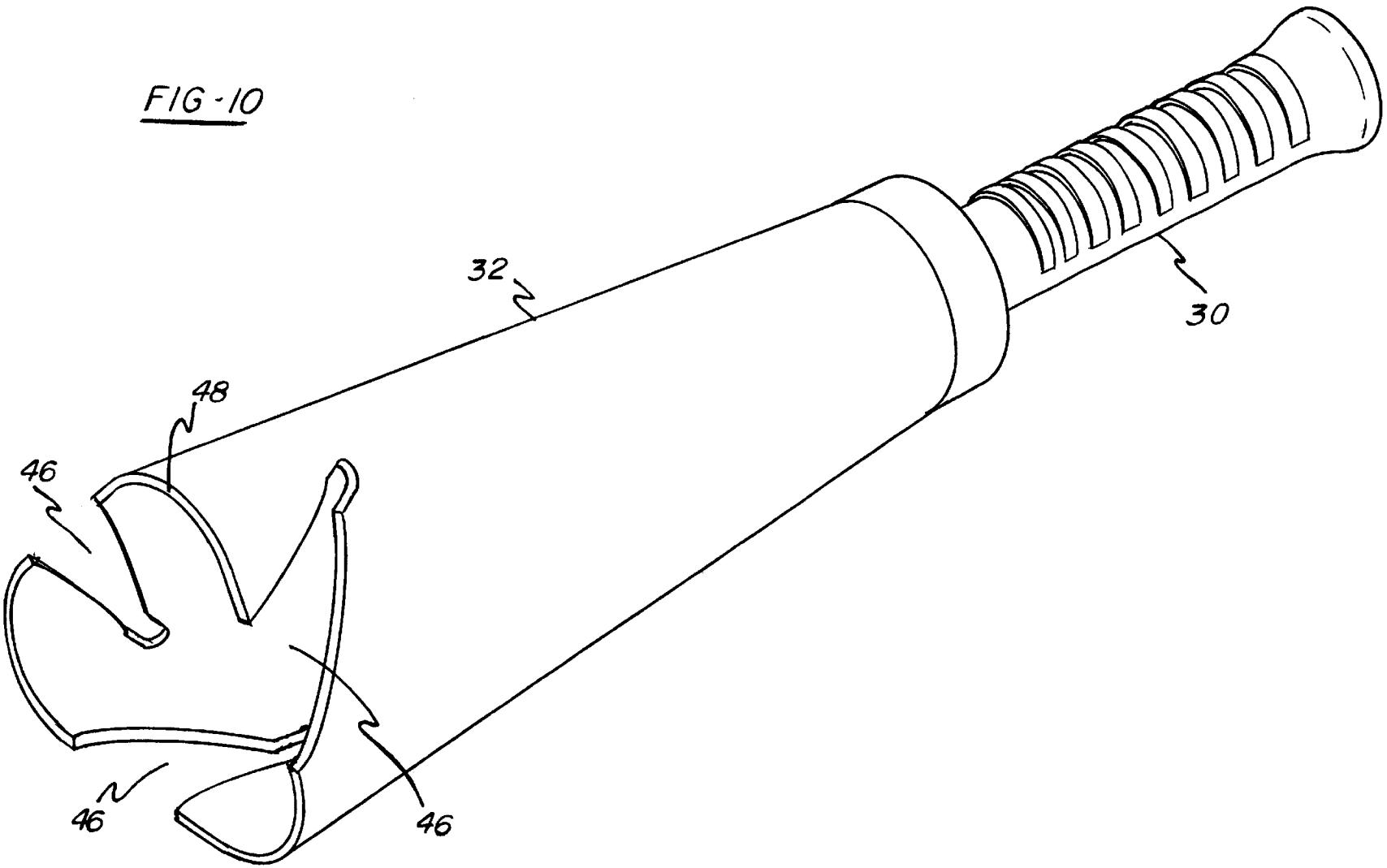
FIGS. 10 and 11 are perspective and bottom end views, respectively, of a second alternative embodiment of the wringer sleeve.
Figure 11:
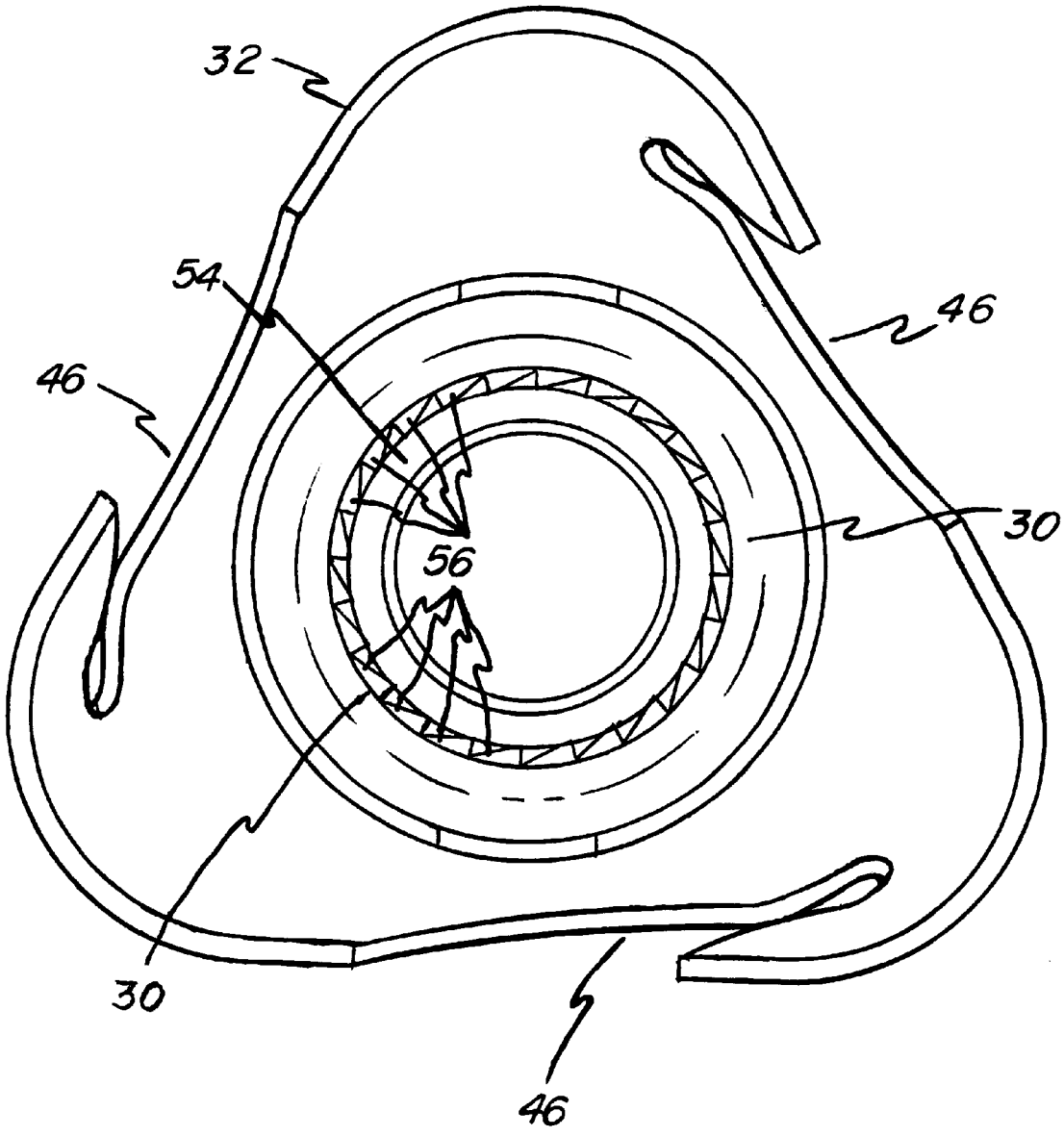

Referring to FIGS. 10 and 11, a second alternative embodiment of the wringer sleeve 28 is illustrated in which the mop body receiving portion 32 is formed with a generally triangular shape and includes three slots 46 in the distal end 48 thereof.

Figure 12:
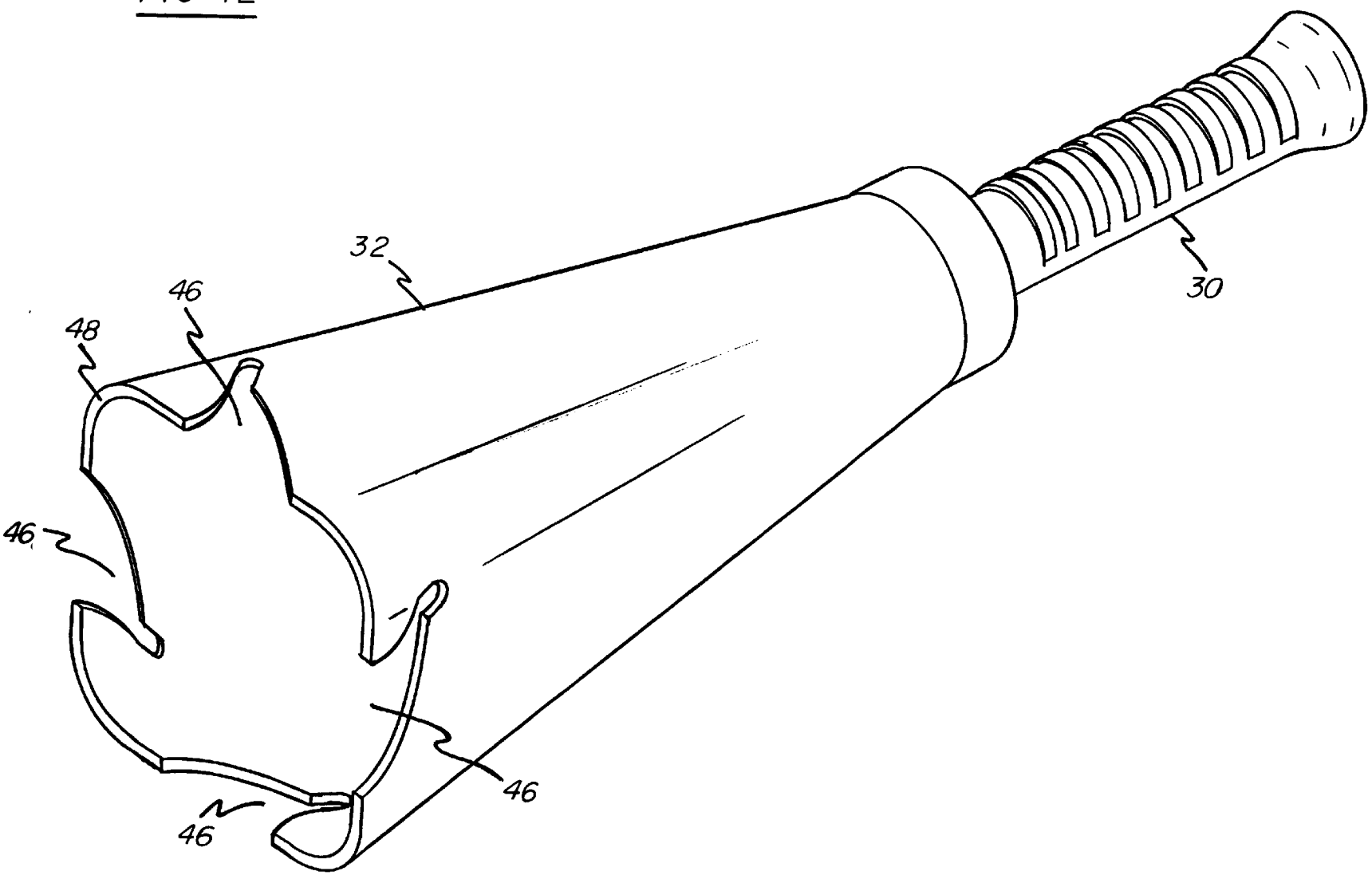
FIGS. 12 and 13 are perspective and bottom end views, respectively, of a third alternative embodiment of the wringer sleeve.
Figure 13:
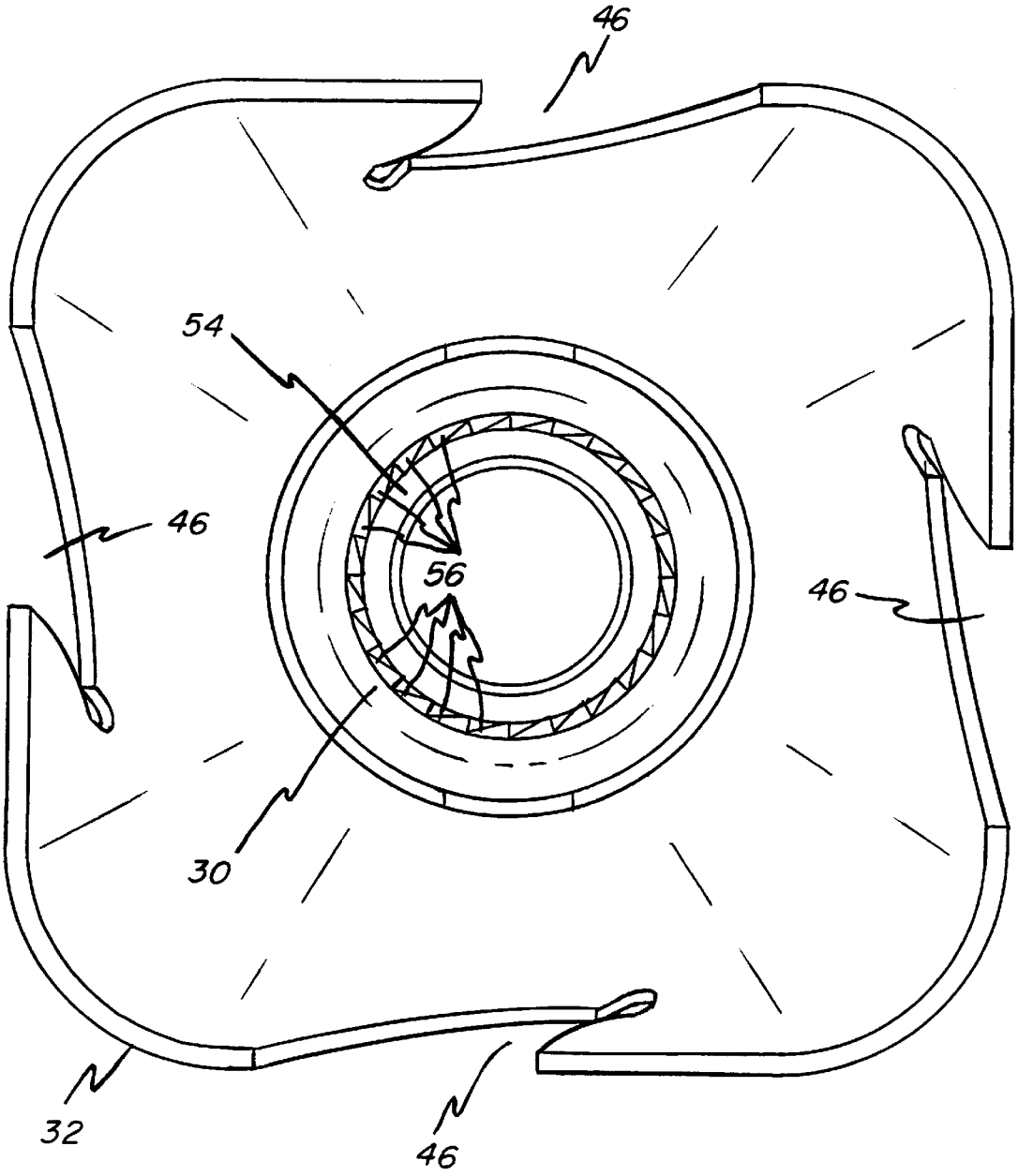

Referring to FIGS. 12 and 13, a third alternative embodiment of the wringer sleeve 28 is illustrated in which the mop body receiving portion 32 is formed with a generally square shape and includes four slots 46 located in the distal end 48 of the mop body receiving portion 32.

Accordingly, it can be seen that a variety of configurations for the mop body receiving portion 32 may be provided within the scope of the present invention to facilitate engagement and gripping of the mop strands of the mop body 24.

While the form of apparatus herein described constitutes a preferred embodiment of this invention, it is to be understood that the invention is not limited to this precise form of apparatus, and that changes may be made therein without departing from the scope of the invention which is defined in the appended claims.

What is claimed is:

1. A mop comprising:

an elongated handle having first and second ends and defining a longitudinal axis;

a mop head located at said second end of said handle, said mop head including a plurality of flexible strands defining a mop body;

a sleeve defined by inner and outer surfaces extending circumferentially around said longitudinal axis to form a tubular shell, said sleeve including opposing first and second ends; and wherein said second end of said sleeve defines an engagement portion defined by an engagement surface comprising an axially protruding portion located at said second end of said sleeve and extending between said inner and outer surfaces of said sleeve, the engagement portion for engaging said mop body and for facilitating gripping and twisting of said mop strands during rotational movement of said sleeve relative to said handle.

2. The mop of claim 1 wherein there are plural protruding portions and further including slot portions defined between said protruding portions to define areas for receiving and engaging said mop strands.

3. The mop of claim 2 wherein said slot portions extend at an angle relative to said longitudinal axis to facilitate engagement between said sleeve and said mop strands to twist said mop strands during said rotational movement of said sleeve.

4. The mop of claim 1 including cooperating portions on said handle and said sleeve for permitting rotation of said sleeve relative to said handle in one direction and for preventing rotation of said sleeve in a second, opposite direction.

5. The mop of claim 4 wherein said cooperating portions comprise a pawl portion cooperating with a detent portion.

6. The mop of claim 5 wherein said detent portion comprises a plurality of longitudinally extending ribs, and said pawl portion comprises at least one pawl member resiliently biased toward engagement with said ribs.

7. The mop of claim 4 wherein said cooperating portions comprise a first cooperating portion located adjacent said first end of said sleeve, and a second cooperating portion located adjacent said second end of said mop handle.

8. The mop of claim 7 wherein said first cooperating portion is longitudinally moveable with said sleeve whereby longitudinal movement of said first cooperating portion toward said second end of said mop handle moves said first cooperating portion into engagement with said second cooperating portion.

9. The mop of claim 1 wherein said sleeve defines a non-circular cross-section.

10. The mop of claim 9 wherein said non-circular cross-section of said sleeve comprises an oval.

11. The mop of claim 1 including a generally cylindrical hand grip attached to said handle between said first and second ends of said handle and defining a gripping surface located radially outwardly from a surface of said handle, said first end of said sleeve defining an inner diameter substantially equal to an outer diameter of said hand grip whereby said first end of said sleeve engages said hand grip in frictional engagement.

12. A mop comprising:

an elongated handle having first and second ends and defining a longitudinal axis;

a mop head located at said second end of said handle, said mop head including a plurality of flexible strands defining a mop body;

a sleeve defined by inner and outer surfaces extending circumferentially around said longitudinal axis to form a tubular shell, said sleeve including opposing first and second ends, said second end of said sleeve defining an engagement portion defined by an engagement surface comprising an axially protruding portion located at said second end of said sleeve and extending between said inner and outer surfaces of said sleeve, the engagement portion for gripping and twisting of said mop strands during rotational movement of said sleeve relative to said handle; and cooperating portions on said handle and said sleeve for permitting rotation of said sleeve relative to said handle in one direction and for preventing rotation of said sleeve in a second, opposite direction.

13. The mop of claim 12 wherein said cooperating portions comprise a pawl portion cooperating with a detent portion.

14. The mop of claim 13 wherein said detent portion comprises a plurality of longitudinally extending ribs, and said pawl portion comprises at least one pawl member resiliently biased toward engagement with said ribs.

15. The mop of claim 12 wherein said cooperating portions comprise a first cooperating portion located adjacent said first end of said sleeve, and a second cooperating portion located adjacent said second end of said mop handle.

16. The mop of claim 15 wherein said first cooperating portion is longitudinally moveable with said sleeve whereby longitudinal movement of said first cooperating portion toward said second end of said mop handle moves said first cooperating portion into engagement with said second cooperating portion.

17. The mop of claim 16 wherein said second cooperating portion is integral with said mop head.

18. The mop of claim 12 wherein said engagement portion for gripping and twisting said mop strands comprises a plurality of engagement surfaces defined at said second end of said sleeve by a plurality of axially extending slots forming cut-out areas for receiving and engaging said mop strands.

19. A mop comprising:

an elongated handle having first and second ends and defining a longitudinal axis;

a mop head located at said second end of said handle, said mop head including a plurality of flexible strands defining a mop body;

a sleeve defined by inner and outer surfaces extending circumferentially around said longitudinal axis to form a tubular shell, said sleeve including opposing first and second ends, said second end of said sleeve defining an engagement portion defined by an engagement surface comprising an axially protruding portion located at said second end of said sleeve and extending between said inner and outer surfaces of said sleeve, the engagement portion for gripping and twisting of said mop strands during rotational movement of said sleeve relative to said handle; and including a generally cylindrical hand grip attached to said handle between said first and second ends of said handle, said first end of said sleeve defining an inner diameter substantially equal to an outer diameter of said hand grip whereby said first end of said sleeve engages said hand grip in frictional engagement to retain said sleeve at a position spaced from said mop body.

20. The mop of claim 19 wherein said hand grip comprises a resilient material.

21. The mop of claim 20 wherein said resilient material defines a textured surface.

22. The mop of claim 19 wherein said hand grip is smoothly contoured for engaging said inner diameter of said sleeve is sliding frictional engagement as said sleeve is moved axially relative to said handle.

23. The mop of claim 19 wherein said hand grip includes an end surface and said inner surface of said sleeve includes a radially inwardly extending protrusion for engaging said end surface of said hand grip to limit axial movement of said sleeve toward said first end of said mop handle.

24. The mop of claim 19 wherein said engagement portion for gripping and twisting said mop strands comprises a plurality of engagement surfaces defined at said second end of said sleeve by a plurality of axially extending slots forming cut-out areas for receiving and engaging said mop strands.

* * * * *